United States Patent [19]

Brynildsen

[11] Patent Number: 4,717,426

[45] Date of Patent: Jan. 5, 1988

[54] METHOD AND DEVICE FOR CLEANING PRINTING INK AND PRINTING MOULD FOR SERIGRAPHY SCREENS

[76] Inventor: Erik Brynildsen, Haukeveien 19, 1340 Bekkestua, Norway

[21] Appl. No.: 789,976

[22] Filed: Oct. 21, 1985

[30] Foreign Application Priority Data

Nov. 8, 1984 [NO] Norway ..... 844469

[51] Int. Cl.[4] ..... B08B 30/00

[52] U.S. Cl. ..... 134/26; 101/423; 101/424; 101/425; 134/27; 134/41

[58] Field of Search ..... 134/2, 3, 28, 29, 41, 134/27; 228/206; 101/423, 424, 425

[56] References Cited

U.S. PATENT DOCUMENTS 3,457,107 7/1969 Mickelson ..... 134/28

3,489,625 1/1970 Dell ..... 134/2 X 3,622,391 11/1971 Baldi ..... 134/28

3,677,953 7/1972 Harris ..... 134/2 X 4,477,364 10/1984 Garcia ..... 134/3

*Primary Examiner*—Andrew H. Metz

*Assistant Examiner*—Sharon T. Cohen

*Attorney, Agent, or Firm*—Seidel, Gonda, Goldhammer & Abbott

[57] ABSTRACT

Method by cleaning of printing ink and printing mould from the screen of a serigraphical frame (3), where the screen is cleaned with high pressure water to which has been added alkaline washing powder, to loosen the printing ink and the printing mould, thereafter flushing the screen with high pressure water to remove possible remaining printing ink and printing mould and finally to dry the cleaned screen for reuse.

4 Claims, 2 Drawing Figures

METHOD AND DEVICE FOR CLEANING PRINTING INK AND PRINTING MOULD FOR SERIGRAPHY SCREENS

The present invention is related to a method and a device according to the preamble of the claims.

Serigraphical printing possesses a number of advantages in that printing may take place on a great number of different materials by means of special printing inks, substantially based on solvents.

The dependency of solvents, however, establishes a problem in connection with cleaning of the screen which is stretched in a frame of wood or aluminium and to which the printing mould itself is secured. When the printing mould and remainders of the printing ink are cleaned from the screen, one solution for dissolving the printing ink and thereafter one solution for dissolving the printing mould itself, have been used. The use of such solutions partly involves great environmental problems even if the operations are handled in closed installations. Additionally the consumption of solution has been great, which gives the rise to increase problems in connection with the effluence.

By the method and device according to the invention, evironmental and effluent problems are avoided in connection with the use of solutions and still a screen is achieved without printing ink and printing mould. Furthermore the removal of the printing ink and printing mould is performed in the same operation. According to the invention this is achieved by the features stated in the characterizing clauses of the claims.

By making a serigraphical print, a printing ink is used, comprising pigments and binders as well as solutions which evaporate.

The screen used in serigraphical frames normally is weaved of polyester, nylon or steel and the printing mould is transfered to the screen as a tight layer on one side of the screen or by filling out the openings in the screen at desired places in accordance with the desired printing picture. This is the reason why the printing ink will fill out the open spaces between the single threads in the screen or will be placed as a layer on one side of the screen respectively, whereby those areas which are supposed to submit printing ink by the printing in both cases have open spaces in the screen which are filled with printing ink.

The solution in the printing ink contributes to a certain degree to dissolve the surface of the material to be printed, thereby anchoring the printing ink to the surface in such a way that the finished picture to a certain extent becomes an intergrated part of the material on which the printing is performed. The solution in the printing ink, however, will not affect nylon, steel or polyester and the printing ink therefore only will reside on the surface of the printing mould and the screen, in such a way that it can be removed without attaching the screen itself.

Figure 1:
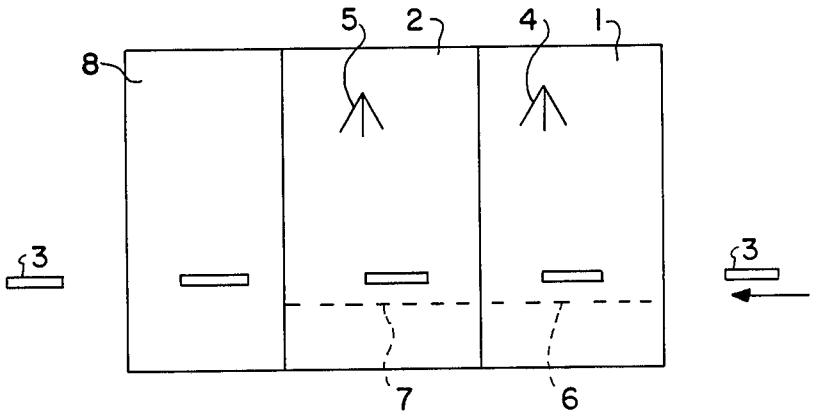
Figure 2:
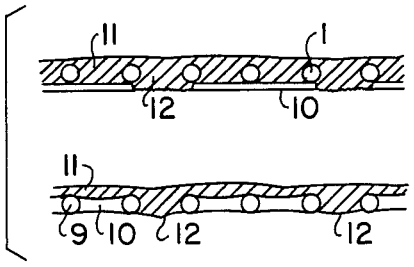

The invention is described based on the drawings where FIG. 1 schematically discloses a device for cleaning serigraphical frames and FIG. 2 discloses a cross section through the screen, depicting two principally different arrangements of the printing screen and corresponding distribution of the printing ink.

For cleaning of serigraphical frames according to the invention, a device is used as disclosed in FIG. 1. The device comprises two separate chambers, one cleaning chamber 1 and one flushing chamber 2. The serigraphical frame 2 including the screen, first is arranged in the cleaning chamber 1 where several nozzles 4 for high pressure flushing are arranged, partly displaceable. By means of the nozzles 4 a mixture of water and washing powder, both being heated to between 40° and 70° C., preferably between 60° and 70° C., is sprayed at high pressure against the frame 3. The washing powder is alkaline and preferably based on a combination of effectively destructable tensides together with phosphate and free alkalies. The high pressure spraying in connection with the temperature and the alkaline washing powder loosens the hardened printing ink and the printing mould a well, from the screen, in such a way that both the printing ink and the printing mould are broken out and loosened from the screen in relatively large particles. The particles are captured by a sieve 6 arranged under the frame 3, whereas the heated water including the washing powder is penetrating the sieve 6 and collected in the lower part of the washing chamber 4. The mixture of water and washing powder from here is suck up for again being sprayed on the frame at high pressure. The particles falling down from the frame very easily can be removed and thrown away by taking out the sieve 6. After the printing ink and the printing mould have been removed from the screen and substantially have fallen down as particles on to the sieve 6, the frame 3 is moved to the spraying chamber 2 where it is sprayed with water from a high pressure spraying nozzle 5 to clean away possible particle remainders on the screen. In a corresponding way particles also here are captured by a sieve 7, whereas water is collected in the lower part of the spraying chamber 2 and reused or discharged, as this does not create pollution problems.

After the frame 3 in this way has been cleaned, it is moved to another part of the spraying chamber 2 or to a third chamber 8 where it is dried before it leaves the device and again can be used.

FIG. 2 discloses a section through the screen in a serigraphical frame, having threads 9 which are parallel and which in the figure are shown in section. In the upper part of FIG. 2 a printing mould 10 is disclosed which is arranged on the lower surface of the screen itself, whereas printing ink 11 is distributed in the spaces between the single threads 9 on the upper surface of the printing mould 10, and in the open spaces 12 in the screen as well. The lower part of FIG. 2 discloses another principle where the printing mould 10 is arranged between the threads 9 and where the printing ink 11 is distributed as a layer on the upper surface of the screen and filling out the open space 12 as well.

The cleaning chamber 1 is closed to avoid squirt of atomized washing powder, whereas a foam dampening agent in a desirable way can be submitted to the mixture of washing powder and water.

I claim:

1. A method of cleaning printing ink and printing mould from a screen of a serigraphical printing frame which comprises applying a first high pressure aqueous flush to said screen to loosen said printing ink and printing mould wherein the aqueous flush comprises heated water to which an alkaline washing powder has been added, followed by applying to said screen a second high pressure flush comprising water to remove remaining printing ink and printing mould from said screen and thereafter drying the cleaned screen for reuse.

2. The method according to claim 1 wherein the first aqueous flush is heated to a temperature of up to 40°–70° C. and contains a combination of effective desctructive tensides, phosphates, and alkalies.

3. The method according to claim 1 wherein the first aqueous flush further comprises a foam dampening agent.

4. The method according to claim 2 wherein the first aqueous flush further comprises a foam dampening agent.

* * * * *